US010118103B2

(12) United States Patent
Muraki

(10) Patent No.: US 10,118,103 B2
(45) Date of Patent: Nov. 6, 2018

(54) TOY TOP

(71) Applicant: TOMY COMPANY, LTD., Tokyo (JP)

(72) Inventor: Makoto Muraki, Tokyo (JP)

(73) Assignee: TOMY COMPANY, LTD., Tokyo (JP)

( * ) Notice: Subject to any disclaimer, the term of this patent is extended or adjusted under 35 U.S.C. 154(b) by 0 days.

(21) Appl. No.: 15/785,583

(22) Filed: Oct. 17, 2017

(65) Prior Publication Data

US 2018/0104603 A1 Apr. 19, 2018

(30) Foreign Application Priority Data

Oct. 18, 2016 (JP) ..... 2016-204634

(51) Int. Cl.
*A63H 1/00* (2006.01)
*A63H 1/04* (2006.01)
*A63H 1/02* (2006.01)

(52) U.S. Cl.
CPC ..... *A63H 1/04* (2013.01); *A63H 1/00* (2013.01); *A63H 1/02* (2013.01)

(58) Field of Classification Search
CPC ..... A63H 1/00; A63H 1/02; A63H 1/18
USPC ..... 446/256
See application file for complete search history.

(56) References Cited

U.S. PATENT DOCUMENTS 2,435,445 A * 2/1948 Kerezi ..... A63H 1/00 446/255
3,785,081 A * 1/1974 Burkhart ..... A63H 1/20 446/213
5,941,753 A * 8/1999 Diresta ..... A63H 1/18 446/257
6,364,734 B1 * 4/2002 Ng ..... A63H 1/00 446/236
6,746,300 B1 * 6/2004 Matsukawa ..... A63H 1/06 446/256
8,210,895 B2 * 7/2012 Bertrand ..... A63F 9/16 446/259

(Continued)

FOREIGN PATENT DOCUMENTS

JP 2003-62354 3/2003
JP 2005-328976 12/2005

(Continued)

OTHER PUBLICATIONS http://www.beach.jp/circleboard/ac43609/topic/1100025965113 Webpage downloaded Sep. 29, 2017.

(Continued)

*Primary Examiner* — Alexander Niconovich
(74) *Attorney, Agent, or Firm* — Staas & Halsey LLP

(57) ABSTRACT

A toy top includes a body and a shaft unit. The body includes rotating components which are attached to be rotatable relative to each other. At least two of the rotating components include respective contact portions which come in contact with each other to regulate a rotation range between the two rotating components. The contact portions are configured such that contact between the contact portions gradually become loose as the contact portions repeatedly come in contact with each other due to relative rotation of the two rotating components, and capability of regulating rotation is eventually lost so that the rotation range is expanded.

3 Claims, 9 Drawing Sheets

(56) References Cited

U.S. PATENT DOCUMENTS

| | | | | |
|---|---|---|---|---|
| 9,101,845 | B2 * | 8/2015 | Cai | A63H 1/18 |
| 9,566,529 | B1 * | 2/2017 | Shindo | A63H 1/02 |
| 9,737,820 | B2 * | 8/2017 | Cai | A63H 1/00 |
| 9,802,134 | B2 * | 10/2017 | Cai | A63H 1/02 |
| 9,849,393 | B2 * | 12/2017 | Muraki | A63H 1/00 |
| 9,849,395 | B1 * | 12/2017 | Muraki | A63H 1/02 |
| 10,029,185 | B2 * | 7/2018 | Cai | A63H 1/18 |
| 2009/0253344 | A1 * | 10/2009 | Ujita | A63H 1/02 446/256 |
| 2011/0006479 | A1 * | 1/2011 | Ujita | A63H 1/16 273/147 |
| 2011/0171876 | A1 * | 7/2011 | Ujita | A63H 1/00 446/264 |
| 2011/0256795 | A1 * | 10/2011 | Ujita | A63H 1/00 446/264 |
| 2011/0256796 | A1 * | 10/2011 | Ujita | A63H 1/00 446/264 |
| 2016/0325190 | A1 * | 11/2016 | Muraki | A63H 1/02 |
| 2017/0203218 | A1 * | 7/2017 | Muraki | A63H 1/00 |
| 2018/0104602 | A1 * | 4/2018 | Muraki | A63H 1/00 |

FOREIGN PATENT DOCUMENTS

| | | | |
|---|---|---|---|
| JP | 2006-55333 | | 3/2006 |
| JP | 3151712 | | 6/2009 |
| JP | 3151700 | | 7/2009 |
| JP | 2014-533594 | | 12/2014 |
| WO | 2013/078896 | A1 | 6/2013 |

OTHER PUBLICATIONS

Office Action for Japanese Patent Application No. 2016-204634, dated May 30, 2017.

J-PlatPat English Abstract for Japanese Patent Application Publication No. 2003-062354, published Mar. 4, 2003.

J-PlatPat English Abstract for Japanese Patent Application Publication No. 2005-328976, published Dec. 2, 2005.

WIPO English Abstract for PCT Patent Application Publication No. 2013/078896, published Jun. 6, 2013.

Extended European Search Report dated Apr. 23, 2018, in corresponding European Patent Application No. 17197019.7, 5 pgs.

J-PlatPat English Abstract for Japanese Patent Publication No. 2006-55333, published Mar. 2, 2006.

J-PlatPat English Abstract for Japanese Patent No. 3151712, published Jun. 10, 2009.

* cited by examiner

TOY TOP

BACKGROUND OF THE INVENTION

1. Field of the Invention

The present invention relates to a toy top.

2. Description of Related Art

The structure of a toy top known in the art is such that a body having a function of attacking an opponent toy top is provided above an axis having a function of defining the moving manner of the toy top (e.g. see Japanese Utility Model No. 3151700 B).

Further, one of such toy tops known in the art includes a body having an upper and lower two-layer structure, in which blades protruding from the circumferences of the respective two layer members are staggered in the circumferential direction, and the two layer members are biased in the circumferential direction (e.g. see the website http://www.beach.jp/circleboard/ac43609/topic/1100025965113).

Although the toy top described in the website has an additional novel attacking mode by means of relative rotation of the biased two layer members, the relative rotation of the two layer members remains the same even after the toy top is used for a long time. Accordingly, the toy top is not amusing enough in some senses.

SUMMARY OF THE INVENTION

The present invention has been made in view of the above-described problem, and an object thereof is to provide an amusing toy top that includes two rotating components of the body.

To achieve at least one of the abovementioned objects, according to an aspect of the present invention, there is provided a toy top including a body and a shaft unit, wherein the body includes rotating components which are attached to be rotatable relative to each other, wherein at least two of the rotating components include respective contact portions which come in contact with each other to regulate a rotation range between the two rotating components, and wherein the contact portions are configured such that contact between the contact portions gradually becomes loose as the contact portions repeatedly come in contact with each other due to relative rotation of the two rotating components, and capability of regulating rotation is eventually lost so that the rotation range is expanded.

Preferably, the toy top further includes an additional component which rotatably supports a first rotating component of the two rotating components between the additional component and a second rotating component of the two rotating components and which is fixed on the second rotating component, wherein the additional component has a hole for attaching an accessory, and wherein the hole is closed by the first rotating component in a first state in which the rotation range of the two rotating components has not been expanded yet, and when the first state is changed to a second state in which the rotation range is expanded, the first rotating component is relatively rotated so that the hole is opened.

Preferably, the toy top further includes a biasing member which biases the first rotating component in a first rotating direction with respect to the second rotating component, wherein the two rotating components are configured such that when the first state is changed to the second state, the first rotating component is relatively rotated in a second rotating direction opposite to the first rotating direction against a biasing force of the biasing member.

Preferably, the first rotating component includes a supporting portion which supports the biasing member and which closes the hole of the additional component in the first state and is moved in the second rotating direction over the hole to open the hole when the first state is changed to the second state, and in the second state, an attaching portion of the accessory is inserted into the hole of the additional component to abut the supporting portion of the first rotating component, and rotation of the first rotating component by means of the biasing member is thereby regulated so that the second state is retained.

In the present invention, the two rotating components of the body include the respective contact portions. As the contact portions repeatedly come in contact with each other due to relative rotation of the two rotating components, the contact between the contact portions gradually becomes loose, and the capability of regulating rotation is eventually lost so that the rotation range is expanded.

In this way, the rotation range of the two rotating components is expanded when the player uses the toy top for a long time, which enables achieving an amusing toy top.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention, and wherein.

DESCRIPTION OF EMBODIMENTS

Hereinafter, embodiments of the present invention will be described with reference to the drawings. Though various technical limitations which are preferable to perform the present invention are included in the after-mentioned embodiment, the scope of the invention is not limited to the following embodiment and the illustrated examples.

General Configuration

Figure 1A:
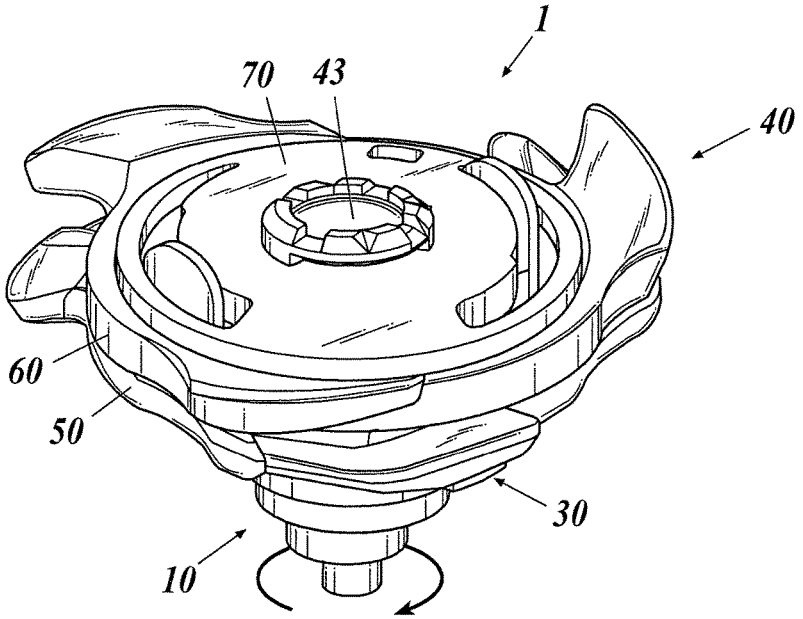
FIG. 1A is a perspective view of a toy top according to an embodiment of the present invention.
Figure 1B:
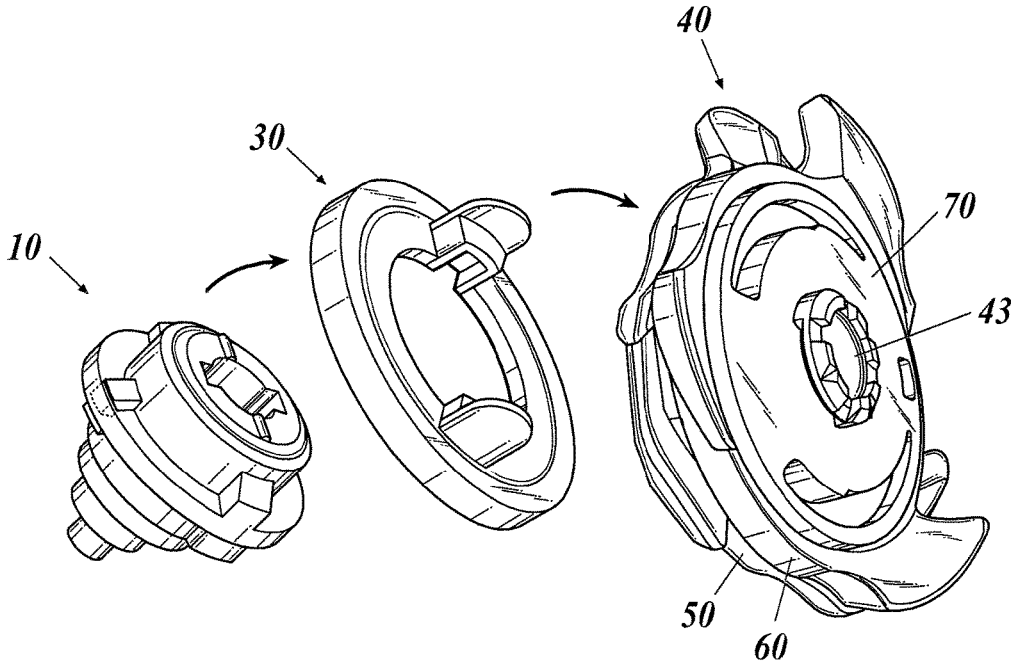
FIG. 1B illustrates how to play a toy top according to an embodiment of the present invention.
Figure 2:
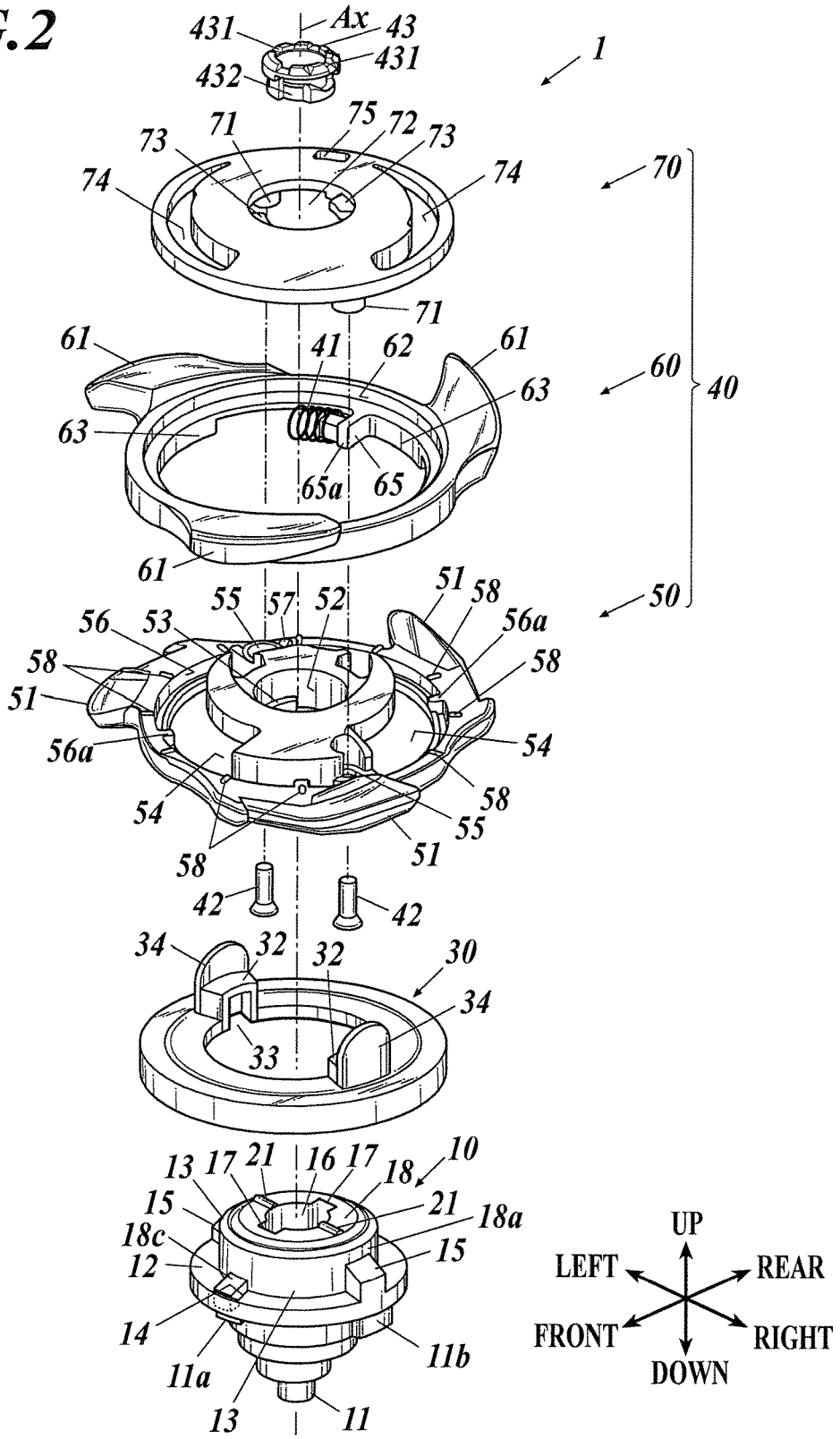
FIG. 2 is an exploded perspective view of the toy top according to the embodiment.

FIG. 1A is a perspective view of a toy top according to an embodiment of the present invention. FIG. 1B illustrates how to play the toy top. FIG. 2 is an exploded perspective view of the toy top 1 according to the embodiment. As used herein, the terms up-down, right-left and front-rear represent the respective directions as illustrated in FIG. 2.

As shown in FIG. 1A, the toy top 1 of the embodiment is of a type that can be used in a so-called "top battle game". Specifically, the toy top 1 can be used in a battle game in which a player wins the game when an opponent toy top 1 is disassembled as illustrated in FIG. 1B by the impact force of a collision between toy tops.

As illustrated in FIG. 2, the toy top 1 is composed of a shaft unit 10 as the lower structure, the shaft unit 10 being a driver, and a performance changing ring 30 and a body 40 which are layered to form the upper structure.

Detailed Configuration

1. Shaft Unit 10

As shown in FIG. 2, the shaft unit 10 includes a spinning shaft 11 in the lower part, a flange 12 in the middle part and a cylinder 13 in the upper part.

Among the above, the flange 12 and the cylinder 13 are formed integrally to constitute the upper section of the shaft unit 10. The flange 12 and the cylinder 13 are fixated to the lower section of the shaft unit 10 with screws (not shown).

The lower section of the shaft unit 10 has a shape where it narrows gradually in steps as approaching the tip of the spinning shaft 11 from the flange 12 and is formed in an approximately reversed cone shape as a whole.

In the flange 12 and the cylinder 13, two holes 14 are formed which are mutually opposed in the front-rear direction across the axis Ax of the spinning shaft 11 which coincides with the vertical axis of the entire toy top 1 (hereinafter referred to simply as the "axis Ax"). On the other hand, protruding pieces 11*a* that protrude outward in the diameter direction are formed at the lower section of the shaft unit at the positions corresponding to the holes 14 of the flange 12. The protruding pieces 11*a* are disposed below the holes 14 of the flange 12. The upper faces of the protruding pieces 11*a* form the after-mentioned seat units.

Further, on the cylinder 13, two protrusions 15 are respectively formed at the positions facing each other in the left-right direction and having the axis Ax therebetween. The outer surfaces of the protrusions 15 are flush with the outer periphery of the flange 12. Further, at the lower section of the shaft unit 10, protrusions 11*b* which protrude outward in the diameter direction are formed at the positions corresponding to the protrusions 15. At the parts corresponding to the protrusions 15 and 11*b* , the flange 12 and the cylinder 13 are fixated to the lower section of the shaft unit 10 with screws (not shown).

Further, a cylindrical pillar 16 is provided inside the cylinder 13 so as to stand (only the upper face is shown in FIG. 2). The base end of the cylindrical pillar 16 is coupled with the lower section of the shaft unit 10. Although it is not limitative in any way, the upper end of the cylindrical pillar 16 is set to be higher than the upper end of the cylinder 13. At the upper end section of the cylindrical pillar 16, two hooks (the second hooks) 17 that protrude outward in the diameter direction are respectively formed at the positions facing each other in the front-rear direction and having the axis Ax therebetween.

The shaft unit 10 further includes a cylindrical pressing member 18. Although the pressing member 18 is made of synthetic resin here, it can be made of metal. The pressing member 18 is provided inside the cylinder 13 so as to surround the outer circumference of the cylindrical pillar 16.

Figure 3:
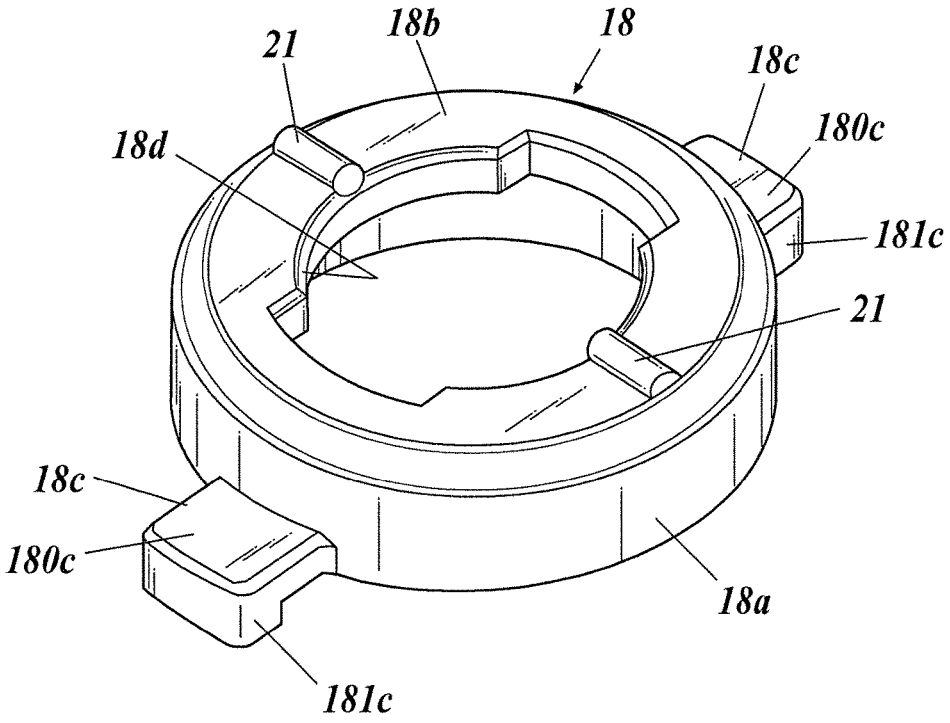
FIG. 3 is a perspective view of a pressing member of the toy top according to the embodiment.

As shown in FIG. 3, the pressing member 18 includes a cylinder unit 18*a*, a ceiling 18*b* and legs 18*c*.

The ceiling 18*b* is provided at the upper end of the cylinder unit 18*a*. The ceiling 18*b* includes a hole 18*d* formed in the shape that corresponds to the upper end part of the cylindrical pillar 16.

Further, the legs 18*c* are formed at the lower end part on the outer periphery of the cylinder unit 18*a*. Two legs 18*c* are respectively formed at the positions facing each other in the front-rear direction and having the axis Ax therebetween. Each of the legs 18*c* is formed of a horizontal unit 180*c* which protrudes horizontally from the cylinder unit 18*a* and a vertical unit 181*c* which extends downward in the vertical direction from the tip of the horizontal unit 180*c*.

The pressing member 18 having the above configuration is provided so that the legs 18*c* can be inserted in the holes 14 as shown in FIG. 2. The holes 14 are formed so that their size in the up-down direction is larger than the length of the legs 18*c* . Further, the pressing member 18 is biased upward by a spring (not shown). With respect to the pressing member 18, the legs 18*c* are restricted from moving upward at the upper edge of the holes 14 and in the normal state, the upper end of the pressing member 18 is at the same height as the upper end of the cylinder 13.

On the upper face of the ceiling 18*b* of the pressing member 18, two ridges (protrusions) 21 which extend in the diameter direction are respectively formed at the positions facing each other in the left-right direction and having the axis Ax therebetween.

2. Performance Changing Ring 30

In the embodiment, the performance changing ring 30 is constituted by a flywheel. The performance changing ring 30 has an approximately ring plate shape. On the bottom face of the performance changing ring 30, an annular step (not shown) is formed which can house the flange 12 of the shaft unit 10 from the lower side. Further, on the upper face of the performance changing ring 30, two protrusions 32 are formed which are mutually opposed in the right-left direction across the axis Ax and protrude upward. On the lower parts of the protrusions 32, recesses 33 are respectively formed which can house the protrusions 15 of the shaft unit 10 from the lower side. Further, on the upper face of the performance changing ring 30, tongues 34 are formed which extend upward along the outer side of the respective protrusions 32. The tongues 34 protrude higher than the protrusions 32. Alternatively, the performance changing ring 30 may be constituted by a member that includes a protrusion on the outer peripheral face for facilitating an attack on an opponent toy top 1 or a member that includes a recess on the outer peripheral face for averting an attack from the opponent toy top 1. Such a member may be provided instead of or integrally with a flywheel.

3. Body 40

Figure 4A:
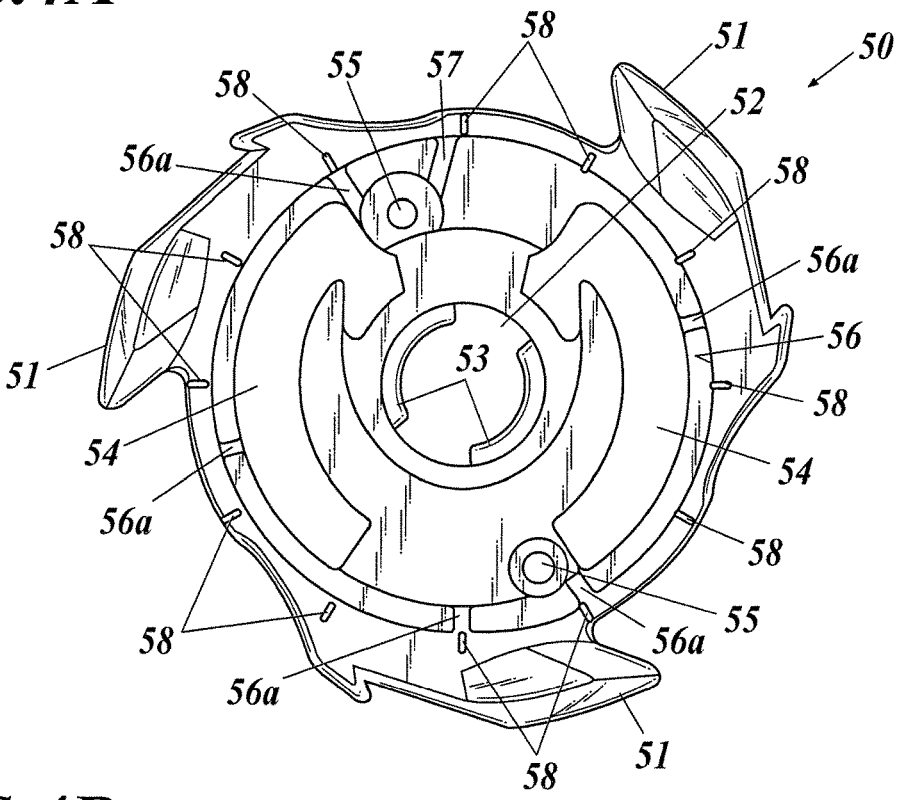
FIG. 4A is a top view of a lower layer member of the toy top according to the embodiment.
Figure 4B:
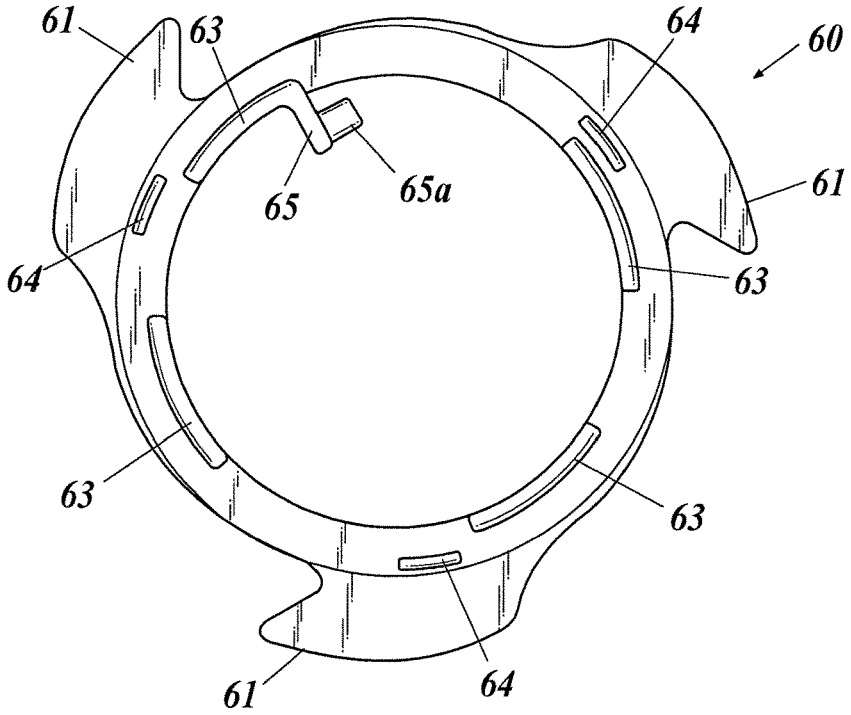
FIG. 4B is a bottom view of an upper layer member of the toy top according to the embodiment.

FIG. 4A is a plan view (top view) of a lower layer member 50 (described later) of the body 40, and FIG. 4B is an upper layer member 60 (described later) of the body 40.

The body 40 has a disk shape. The body 40 includes the lower layer member 50, the upper layer member 60 and a transparent cover 70, which are stacked in the written order from the bottom. In more detail, the body 40 is configured such that the upper layer member 60 is held in a rotatable manner about the axis Ax between the mutually fixed lower layer member 50 and the transparent cover 70 respectively from the upper and lower sides.

As illustrated in FIG. 2 and FIG. 4A, the lower layer member 50 is formed in an approximately disk shape having the center axis along the axis Ax.

From the outer peripheral face of the lower layer member 50, three equally spaced lower blades 51 protrude. The lower blades 51 are formed in a blade shape that extends in the anticlockwise direction to moderately bulge outward and has a sharply angled tip in a plan view.

In the center of the lower layer member 50, a round hole 52 having the center axis along the axis Ax is formed. At the lower end of the inner peripheral face of the round hole 52, two hooks (first hooks) 53 protrude radially inward, which are opposed to each other across the axis Ax. Further, in the center part adjacent to the round hole 52 of the lower end face of the lower layer member 50, two areas mutually opposed in the right-left direction across the axis Ax are formed in a continuous uneven shape, so that uneven portions 59 (only the areas thereof being shown in FIG. 7) that mesh with the ridges 21 of the shaft unit 10 are formed.

In the lower layer member 50, two arc slits 54 are formed, which are mutually opposed across the round hole 52. The tongues 34 of the performance changing ring 30 can be inserted in the arc slits 54 from the lower side. The arc slits 54 have such a length that allows the tongues 34 to move an adequate distance. The lower layer member 50 has two vertical through holes 55 that are mutually opposed across the round hole 52 and located off the arc slits 54 in the circumferential direction.

In the top face of the lower layer member 50, an annular step 56 is formed at the radially outer side of arc slits 54, to which arc guides 63 (described later) of the upper layer member 60 are fitted from the upper side. In the inner face of the annular step 56, regulating walls 56*a* are erected to regulate the rotation range of the upper layer member 60 relative to the lower layer member 50. In the top face of the lower layer member 50, a wall 57 for supporting an end of a biasing spring 41 (described later) is erected in the location slightly deviated from the rear side in the anticlockwise circumferential direction in the plan view.

Further, in the top face of the lower layer member 50, twelve lower protrusions 58 for regulating rotation of the upper layer member 60 are equally spaced along the outer peripheral edge just at the radially outer side of annular step 56.

As illustrated in FIG. 2 and FIG. 4B, the upper layer member 60 is formed in an approximately ring shape having the center axis along the axis Ax.

The upper layer member 60 is approximately formed in the same outer shape and size in the plan view as the lower layer member 50. Three equally spaced upper blades 61 protrude from the outer peripheral face thereof, which have approximately the same shape in the plan view as the lower blades 51 of the lower layer member 50.

In the top face of the upper layer member 60, an annular step 62 is formed, to which the transparent cover 70 can be fitted from the upper side.

In the bottom face of the upper layer member 60, the unequally spaced four arc guides 63 protrude from the inner peripheral edge of the bottom face. The arc guides 63 can be fitted to the annular step 56 in the top face of the lower layer member 50 from the upper side in a circumferentially slidable manner. The arc guides 63 guide the annular step 56 so that the upper layer member 60 is rotatable about the axis Ax relative to the lower layer member 50.

In the bottom face of the upper layer member 60, three upper protrusions 64 that are rather long in the circumferential direction are equally spaced at the radially outer side of the four arc guides 63 along the outer peripheral edge. The upper protrusions 64 come in contact with the lower protrusions 58 of the lower layer member 50 so as to regulate relative rotation about the axis Ax between the lower layer member 50 and the upper layer member 60. At least either of the upper protrusions 64 and the lower protrusions 58 is worn away or deformed as they are repeatedly come in contact with each other. The contact portion between the upper protrusions 64 and the lower protrusions 58 is narrow so that they can eventually overlap each other and the rotation regulating function is lost.

In the inner peripheral face of the upper layer member 60, a support protrusion 65 for supporting the biasing spring (coil spring) 41 protrudes in the rear area. On the anticlockwise-side face in the plan view of the support protrusion 65, a rod 65*a* is erected, which is inserted in the biasing spring 41. The biasing spring 41 is disposed approximately in the circumferential direction, and the anticlockwise-side end abuts the wall 57 of the lower layer member 50 so that the upper layer member 60 is biased in the clockwise direction in the plan view with respect to the lower layer member 50 (see FIG. 5A).

The range of relative rotation between the lower layer member 50 and the upper layer member 60 will be described. FIG. 5 is a plan view illustrating the range of relative rotation.

In an ordinary state, the lower layer member 50 and the upper layer member 60 are rotated relative to each other in the state (within the range) in which the upper blades 61 of the upper layer member 60 are deviated to the clockwise side in the plan view from the lower blades 51 of the lower layer member 50 but the blades are still vertically overlapped.

Figure 5A:
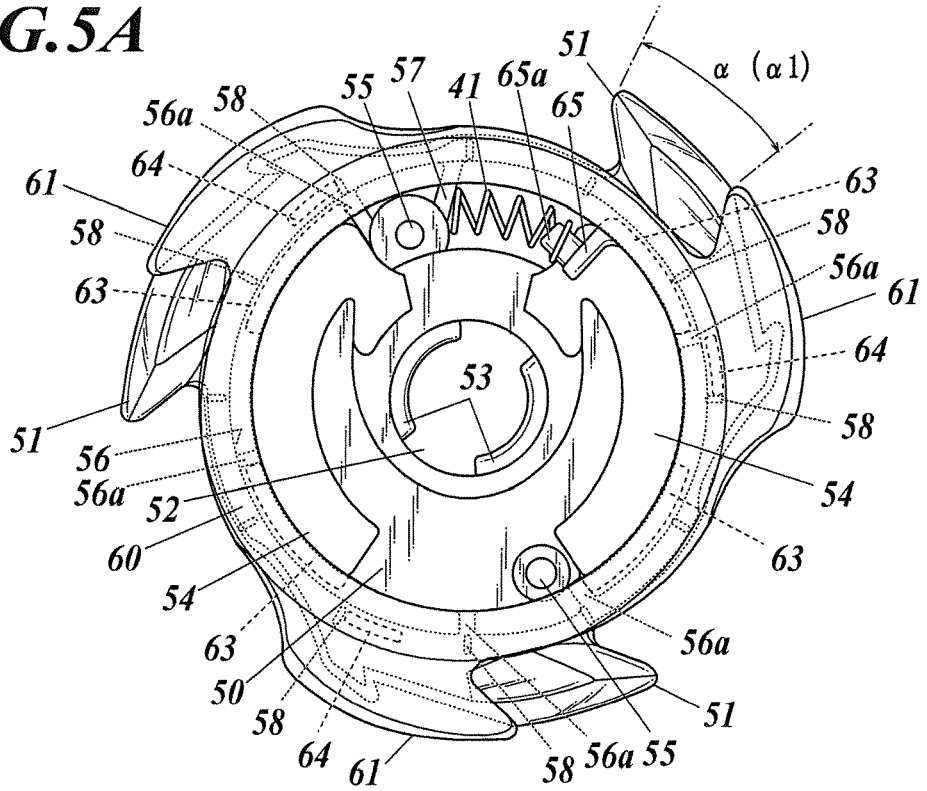
FIG. 5A and FIG. 5B are plan views illustrating the relative rotation range between the lower layer member and the upper layer member of the toy top according to the embodiment.

Specifically, in the state in which little external force is acting on the lower layer member 50 and the upper layer member 60 (hereinafter referred to as an "initial state"), the upper layer member 60 is biased in the clockwise direction in a plan view with respect to the lower layer member 50 by the abutting force of the biasing spring 41 as illustrated in FIG. 5A. The rotation is regulated when the clockwise-side ends in the plan view of the upper protrusions 64 of the upper layer member 60 come in contact with the lower protrusions 58 of the lower layer member 50 and/or the clockwise-side ends in the plan view of the arc guides 63 of the upper layer member 60 come in contact with the regulating walls 56*a* of the lower layer member 50. The contact between the arc guides 63 of the upper layer member 60 and the regulating walls 56*a* of the lower layer member 50 is intended to ensure the regulation of the relative rotation between the upper layer member 60 and the lower layer member 50, and the strength of the contact is greater than that of the contact between the upper protrusions 64 and the lower protrusions 58.

In the initial state, the angle $\alpha$ (center angle about the axis Ax) between the tips of the upper blades 61 of the upper layer member 60 and the tips of the respective lower blades 51 of the lower layer member 50 is $\alpha=\alpha 1$, and the tips of the upper blades 61 are located approximately in the middle in the circumferential direction of the respective lower blades 51.

Figure 5B:
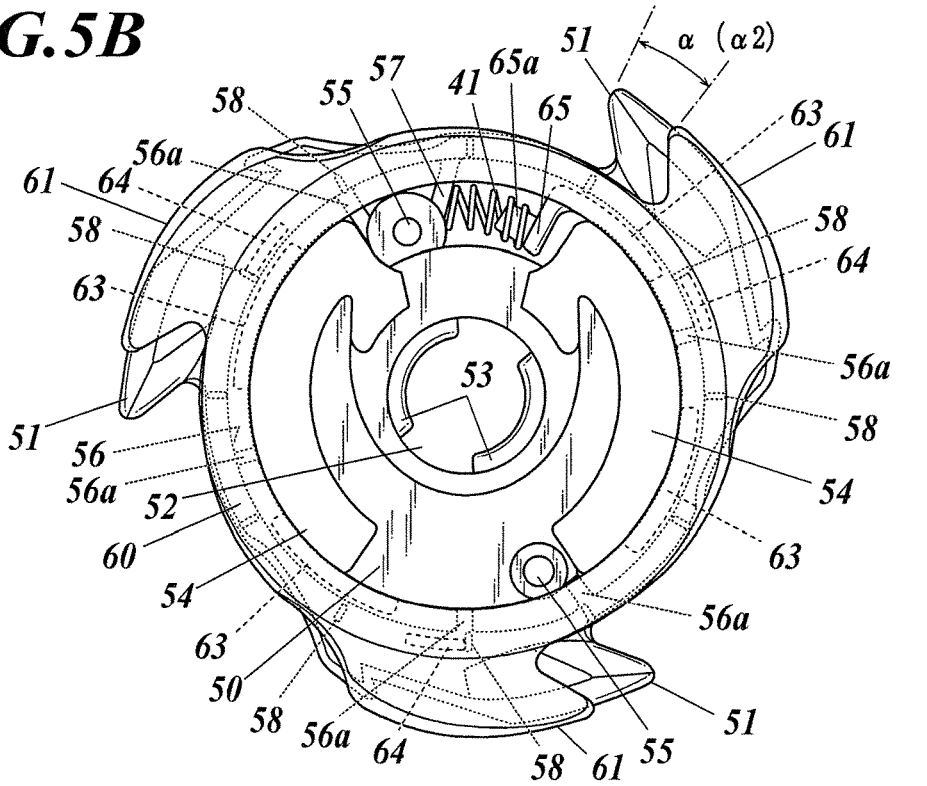

When an external force acts on the upper layer member 60 in the anticlockwise direction in the plan view, for example, due to a contact of the spinning toy top 1 with an opponent toy top 1, the upper layer member 60 is relatively rotated in the anticlockwise direction in the plan view against the biasing force of the biasing spring 41 as illustrated in FIG. 5B until the upper protrusions 64 of the upper layer member 60 come in contact with the lower protrusions 58 of the lower layer member 50 (hereinafter, this rotated state being referred to as a "first rotated state").

In the first rotated state, the angle a between the upper blades 61 of the upper layer member 60 and the respective lower blades 51 of the lower layer member 50 is $\alpha=\alpha 2$ ($<\alpha 1$). That is, the upper layer member 60 can be relatively rotated basically within the angular range of $\alpha 1$ to $\alpha 2$ (approximately 10° in the embodiment) with respect to the lower layer member 50.

However, in the toy top 1 according to the embodiment, the upper protrusions 64 eventually go over the lower protrusions 58 after the clockwise-side ends in the plan view of the upper protrusions 64 of the upper layer member 60 repeatedly come in contact with the lower protrusions 58 of the lower layer member 50 as described later. When this happens, the upper layer member 60 can be further relatively rotated beyond the first rotated state to fall into the state (hereinafter referred to as a "second rotated state", see FIG. 9B) in which the upper layer member 60 is relatively rotated in the anticlockwise direction in the plan view until the anticlockwise-side ends of the arc guides 63 of the upper layer member 60 come in contact with regulating walls 56*a* of the lower layer member 50.

In the second rotated state, the angle a between the tips of the upper blades 61 of the upper layer member 60 and the tips of the respective lower blades 51 of the lower layer member 50 is nearly zero, and the tips of the upper blades 61 and the lower blades 51 are approximately in the same circumferential position.

The transparent cover 70 is formed in an approximately disk shape having the center axis along the axis Ax as illustrated in FIG. 2.

The transparent cover 70 is formed to have approximately the same outer diameter as the annular step 62 of the upper layer member 60. The transparent body 70 is fitted in the annular step 62 from the upper side so as to cover the inner periphery of the ring upper layer member 60.

In the bottom face of the transparent cover 70, two bosses 71 are erected corresponding to the two holes 55 of the lower layer member 50. In the two bosses 71, respective threaded holes (not shown) are formed to be open downward. Screws 42 are inserted through the holes 55 of the lower layer member 50 and fitted in the threaded holes of the bosses 71 so that the lower layer member 50 is fixed on the transparent cover 70.

In the center of the transparent cover 70, a round hole 72 is formed which has the center axis along the axis Ax and approximately the same inner diameter as the round hole 52 of the lower layer member 50. From the inner peripheral face of the round hole 72, two protrusions 73 protrude radially inward, which are mutually opposed across the axis Ax.

In the transparent cover 70, two arc slits 74 are formed which are mutually opposed across the round hole 72. The arc slits 74 are formed in the position and the circumferential length corresponding to the arc slits 54 of the lower layer member 50.

In the transparent cover 70, a locking hole 75 for attaching a second identifier 44 (described later) is further formed. The locking hole 75 is formed at approximately the same radial location as the arc slits 74 and at a circumferential location slightly deviated from the rear side in anticlockwise direction in the plan view. When the lower layer member 50 and the upper layer member 60 are in the initial state or the first rotated state, the locking hole 75 is closed at the lower side by the support protrusion 65 or the biasing spring 41 of the upper layer member 60. When the upper layer member 60 is relatively rotated to fall into the second rotated state, the lower side of the locking hole 75 is opened so that the second identifier 44 can be locked therein (see FIG. 9).

In the initial state, a first identifier 43 is attached in the round hole 72 of the transparent cover 70. The first identifier 43 is used to identify the toy top 1 or the player thereof.

To achieve the identification, identifiers with different patterns and/or colors are prepared in the embodiment, and one identifier selected therefrom by the player is attached to the round hole 72. In the toy top 1 according to the embodiment, in addition to the first identifier 43, the second identifier 44 with a different shape or the like from the first identifier 43 is attachable when in the above-described second rotated state.

The first identifier 43 has an approximately short cylindrical shape as a whole. The first identifier 43 has an inverted conical recess in the center of the top surface. In the rim that surrounds the recess, two operation recesses 431 are formed which are mutually opposed across the axis Ax. In the operation recesses 431, the flange 12 of the shaft unit 10 can be inserted. The first identifier 43 is configured to be operable by moving the shaft unit 10 inserted in the operation recesses 431.

In the outer periphery of the first identifier 43, two grooves 432 are formed which are mutually opposed across the axis thereof. When the first identifier 43 is inserted in the round hole 72 of the transparent cover 70, the protrusions 73 are fitted in the grooves 432. Each of the grooves 432 includes a first part that extends in the up-down direction and is open in the bottom face of the first identifier 43 and a second part that extends in approximately the circumferential direction from the upper end of the first part. By inserting the first identifier 43 into the round hole 72 of the transparent cover 70 from the upper side and then turning it such that that the protrusions 73 of the round hole 72 are moved along the grooves 432, the first identifier 43 can be attached to the round hole 72 of the transparent cover 70.

Figure 6A:
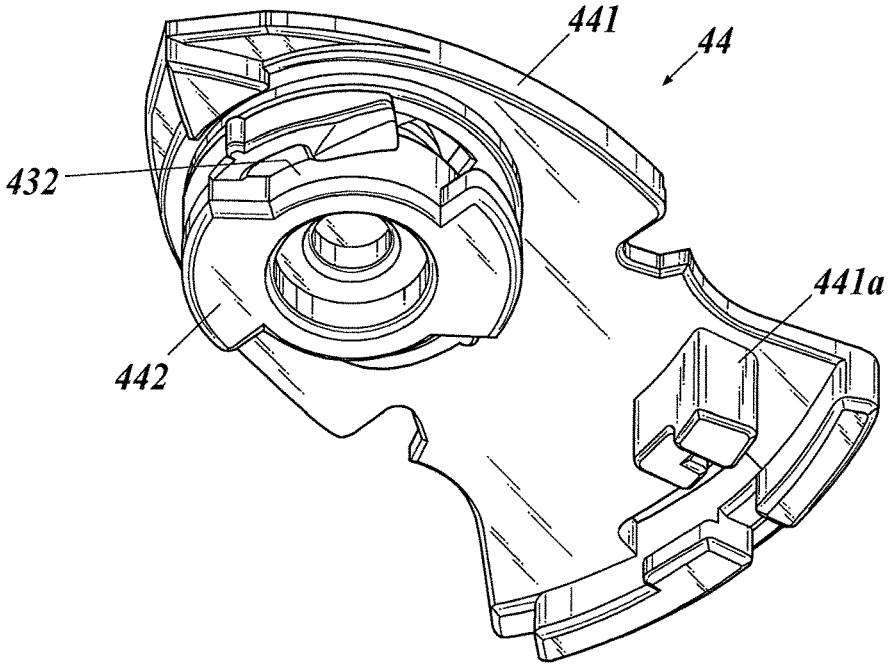
FIG. 6A is a perspective view of a second identifier of the toy top according to the embodiment from obliquely below.
Figure 6B:
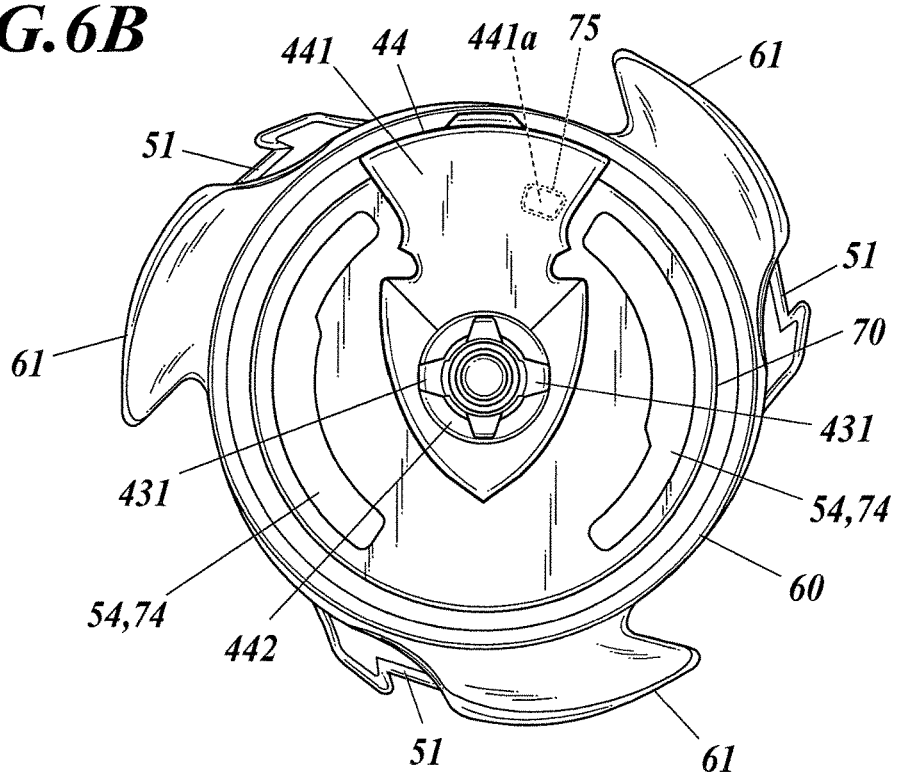
FIG. 6B is a plan view of the second identifier of the toy top according to the embodiment, which is attached to the toy top.

FIG. 6A and FIG. 6B illustrate the second identifier 44, where FIG. 6A is a perspective view from diagonally below, and FIG. 6B is a plan view when attached to the toy top 1.

The second identifier 44 can be attached to the toy top 1 in place of the first identifier 43 when the toy top 1 (body 40) is in the above-described second rotated state. While the first identifier 43 is only intended for identification, the second identifier 44 is further used as a weapon against (for attacking) an opponent toy top or for decorating the toy top 1.

Specifically, as illustrated in FIG. 6A and FIG. 6B, the second identifier 44 includes an approximately flat base plate 441 and a fixing portion 442 to be inserted in the round hole 72 to fix the second identifier 44 itself.

The base plate 441 is formed in a rather long flat plate shape that extends from the center to the peripheral edge of the toy top 1 in the plan view. On the bottom face of the base plate 441, a locking protrusion 441*a* is erected which can be inserted into the locking hole 75 of the transparent cover 70 from the upper side. The locking protrusion 441*a* is formed near the radially outer side end and at the clockwise-side end in the plan view in the bottom face of the base plate 441 when the second identifier 44 is attached to the toy top 1. The lower end of the locking protrusion 441 is formed in a two-step shape such that the clockwise-side step in a plan view is higher than the other step.

The fixing portion 442 is formed in the same shape as that of the first identifier 43 and includes the operation recesses 431 and the grooves 432. The fixing portion 442 is rotatably disposed at the opposite end of the base plate 441 from the locking protrusion 441*a*.

The second identifier 44 is attached to the transparent cover 70 by inserting the fixing portions 442 into the round hole 72 while inserting the locking protrusion 441*a* into the locking hole 75 so as to place it on the transparent cover 70 and then turning the fixing portions 442. However, when the toy top 1 (body 40) is not in the second rotated state, the second identifier 44 cannot be attached to the transparent cover 70 since the locking protrusion 441*a* cannot be inserted down to the locking hole 75 as described later (see FIG. 9).

Assembling Method

Next, an example of the assembling method of the toy top 1 will be described.

FIG. 7 illustrates engagement of the shaft unit 10, the performance changing ring 30 and the body 40.

The shaft unit 10 and the body 40 have been already assembled. Further, the first identifier 43 has been already attached to the transparent cover 70 of the body 40.

Figure 7A:
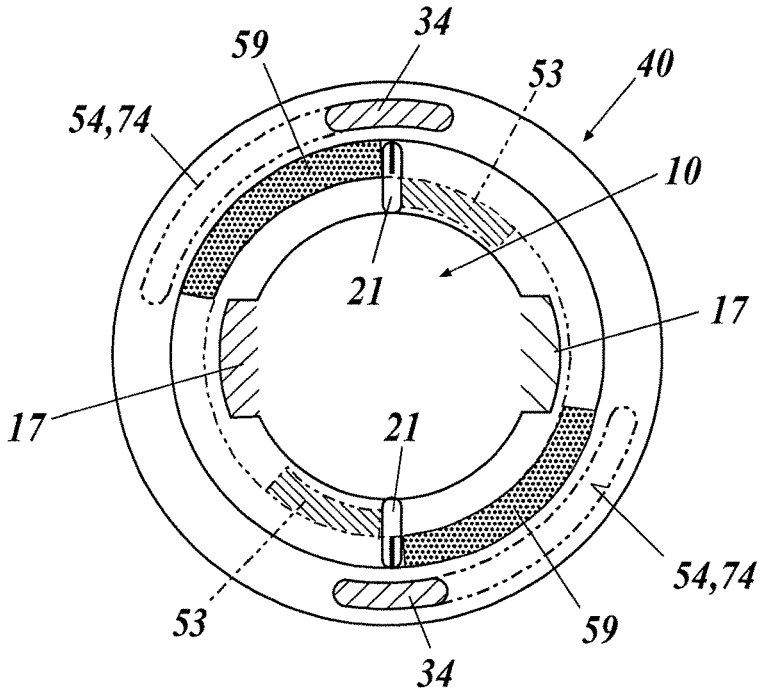
FIG. 7A and FIG. 7B illustrate engagement among a shaft unit, a performance changing ring and a body in the toy top according to the embodiment.
Figure 7B:
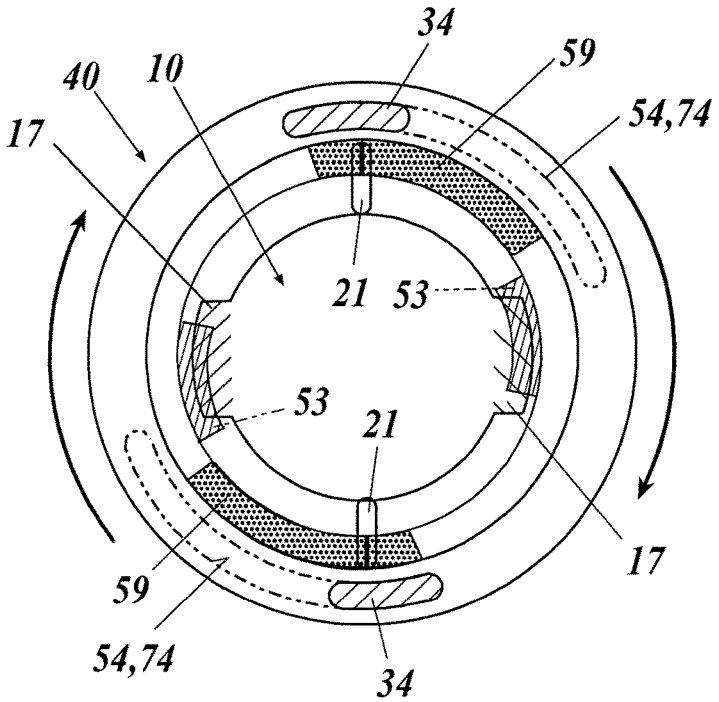

First, the shaft unit 10 is fitted in the performance changing ring 30 from the lower side such that the protrusions 15 of the shaft unit 10 mate with the recesses 33 of the performance changing ring 30. Subsequently, the assembly is brought toward the body 40 from the lower side. In this step, the tongues 34 of the performance changing ring 30 of the assembly are set to predetermined ends of the arc slits 54, 74 of the body 40 (FIG. 7A). In this state, the hooks 17 of the shaft unit do not overlap the hooks 53 of the body 40 in the vertical direction. This state is referred to as a decoupled state. Thereafter, the shaft unit 10 of the assembly is pushed toward the body 40. Further, the spring (not shown) in the shaft unit 10 shrinks and the hooks 17 of the shaft unit 10 are pushed up higher than the hooks 53 of the body 40. Subsequently, the shaft unit together with the performance changing ring 30 is turned relative to the body 40 until the tongues 34 reach the other ends of the predetermined ends (FIG. 7B). This turn is a relative turn between the body 40 and the assembly of the performance changing ring 30 and the shaft unit 10. FIG. 7B illustrates a state in which the body 40 has been already turned relative to the performance changing ring 30 and the shaft unit 10 from the state of FIG. 8A. After this step, the hooks 17 of the shaft unit 10 are aligned with the hooks 53 of the body 40 in the vertical direction. When the shaft unit 10 is released, the lower face of the hooks 17 of the shaft unit 10 abuts the upper face of the hooks 53 of the body 40 due to the action of the biasing force of the spring (not shown) in the shaft unit 10.

The state where the lower faces of the hooks 17 of the shaft unit 10 and the upper faces of the hooks 53 of the body 40 respectively abut is the coupled state. In such way, the shaft unit 10, the performance changing ring 30 and the body 40 are coupled with one another. The toy top 1 is thus assembled.

How to Play

Next, an example of how to play the toy top 1 will be described.

Figure 8:
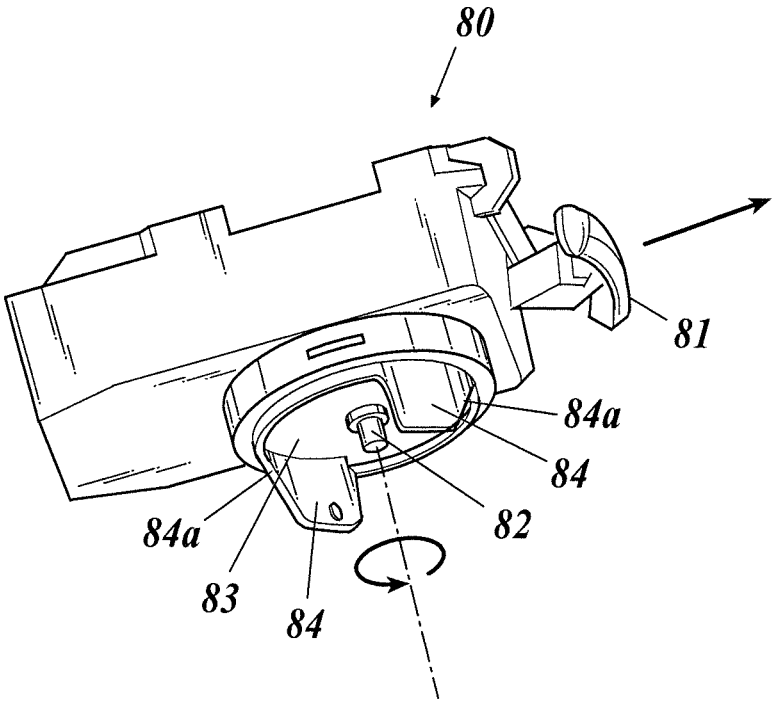
FIG. 8 is a perspective view of an example of a launcher for spinning the toy top according to the embodiment.

FIG. 8 is a perspective view of an example of a launcher for spinning the toy top 1, and FIG. 9 is a plan view of the toy top 1 illustrating the relative rotation range between the lower layer member 50 and the upper layer member 60. In FIG. 9, the first identifier 43 is not shown.

In this example, a player spins a toy top 1 to battle with an opponent toy top 1.

In such cases, a launcher 80 as illustrated in FIG. 8 is used to apply a rotary force to the toy top 1. The launcher 80 includes a disk (not shown) therein. The launcher 80 is configured such that when a string (not shown) wound around the disk is pulled by means of a handle 81 while a spiral spring biases the disk in a certain rotational direction, the disk is rotated, and a top holder 83 is rotated accordingly. The rotation of the top holder 83 is transmitted to the toy top 1 through forks 84 that protrude downward, so that the toy top 1 is rotated. The forks 84 are inserted in the arc slits 54, 74 of the body 40. Then, when the handle 81 of the launcher 80 is completely pulled, the disk and the top holder 83 stop rotating while the toy top 1 continues rotating by the action of its inertial force. Therefore, the toy top 1 moves away from the top holder 83 along the tilted faces 84*a* of the forks 84. In FIG. 8, the reference sign 82 denotes a rod that is retractable into the top holder 83. When the toy top 1 is loaded in the top holder 83, the rod 82 is pushed in the top holder 83 by the upper face of the toy top 1. For example, the rod 82 is used for detecting attachment/detachment of the toy top 1.

The toy top 1 thus launched is led to a predetermined field where it spins in the clockwise direction in the plan view. When the toy top 1 collides with an opponent toy top 1, the impact or friction of the collision produces a reaction force that acts in the body 40 in the direction opposite to the spinning direction of the shaft unit 10 and the performance changing ring 30, and the body 40 thereby relatively turns in the direction opposite to the spinning direction of the shaft unit 10 and the performance changing ring 30.

Then, the ridges 21 mesh with the uneven portions 59 on the bottom face of the body 40 (lower layer member 50) (see FIG. 7). The meshing position is changed every time the impact of a collision acts to rotate the shaft unit 10 relative to the body 40. When the shaft unit 10 eventually reaches the engagement release position, the hooks 53 of the body 40 are released from the hooks 17 of the shaft unit 10, and the body 40 separates from the shaft unit 10 by the action of the biasing force of a spring (not shown) in the shaft unit 10 since the biasing force of the spring in the shaft unit 10 acts on the ridges 21. Accordingly, the toy top 1 is disassembled as illustrated in FIG. 1A.

Figure 9A:
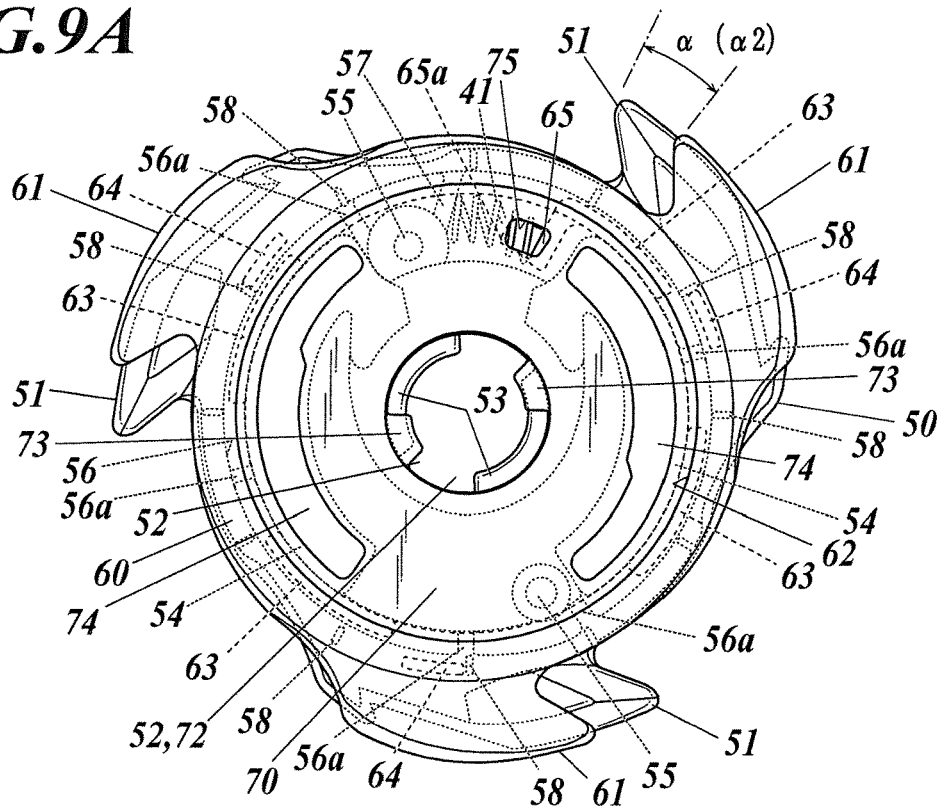
FIG. 9A and FIG. 9B are plan views illustrating the relative rotation range between the lower layer member and the upper layer member of the toy top according to the embodiment.

When the spinning toy top 1 collides with an opponent toy top 1, the body 40 in the initial state reacts such that the upper blades 61 of the upper layer member 60, which are located ahead of the lower blades 51 of the lower layer member 50 in the spinning direction (clockwise direction in the plan view), come in contact with the opponent toy top 1 (see FIG. 5A). The impact of the contact rotates the upper layer member 60 in the anticlockwise direction relative to the lower layer member 50 against the biasing force of the biasing spring 41. As a result, the body 40 falls into the first rotated state in which the anticlockwise-side ends in the plan view of the upper protrusions 64 of the upper layer member 60 are in contact with the lower protrusions 58 of the lower layer member 50 as illustrated in FIG. 9A. Then, as the impact lessens, the lower layer member 50 and the upper layer member 60 return to the initial state by means of the biasing force of the biasing spring 41.

As collision with the opponent toy top 1 is repeated so that the lower layer member 50 and the upper layer member 60 alternate the initial state and the first rotated state, at least either clockwise-side ends in the plan view of the upper protrusions 64 of the upper layer 60 or lower protrusions 58 of the lower layer member 50 are gradually worn away or deformed due to repetitive contact between them. Accordingly, the contact between the upper protrusions 64 and the lower protrusions 58 gradually become loose, and the capability of regulating the relative rotation to the first rotated state is eventually lost so that the rotation range between the lower layer member 50 and the upper layer member 60 is expanded.

Figure 9B:
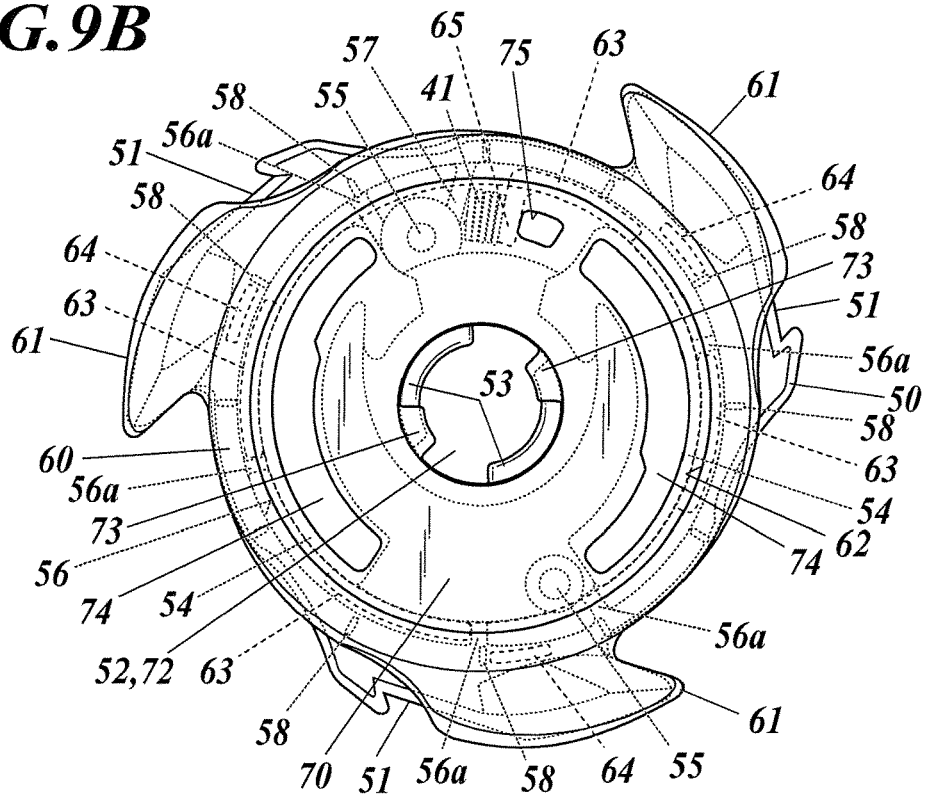

As a result, as illustrated in FIG. 9B, the upper layer member 60 can be relatively rotated further in the anticlockwise direction in the plan view beyond the first rotated state, and the lower layer member 50 and the upper layer member 60 can fall into the second rotated state in which the anticlockwise-side ends of the arc guides 63 of the upper layer member 60 are in contact with the regulating walls 56*a* of the lower layer member 50.

The locking hole 75 of the transparent cover 70 is open in the second rotated state, which was closed in the other states by the support protrusions 65 and the biasing spring 41 of the upper layer member 60. Accordingly, the locking protrusion 441*a* of the second identifier 44 can be inserted into the locking hole 75, and the second identifier 44 can be thus attached to the toy top 1 (transparent cover 70) in place of the first identifier 43 (see FIG. 6). In the second rotated state, when the second identifier 44 is attached on the transparent cover 70 so that the locking protrusion 441*a* is inserted in the locking hole 75, the locking protrusion 441 abuts the support protrusion 65 of the upper layer member 60 to regulate rotation of the upper layer member 60 by means of the biasing force of the biasing spring 41 so that the second rotated state is retained.

Variation of Present Invention

While embodiments of the present invention are described, it is not intended to limit the present invention to these embodiments, and a variety of changes can be made without departing from the features of the present invention.

For example, the above description illustrates an example in which the second identifier 44 is attached to the transparent cover 70 in place of the first identifier 43. However, the configuration of the second identifier 44 is not limited to the embodiments described. For example, performance changing components with a certain weight and shape for changing the rotation characteristics or the attack characteristics, decorating components only for decoration and the like are also applicable.

The locking structure of the first identifier 43 and the second identifier 44 to the transparent cover 70 is not limited to that described above and may also be achieved by screwing.

The above-described embodiments illustrate when the relatively rotating components are composed of two layers (lower layer member 50 and upper layer member 60). However, it is only required that the rotation range of at least two rotating components are expanded as a result of the relative rotation, and the toy top according to the present invention may include three or more rotating components.

Japanese patent application No. 2016-204634 filed on Oct. 18, 2016, including description, claims, drawings, and abstract the entire disclosure is incorporated herein by reference in its entirety.

What is claimed is:

1. A toy top comprising:

a body including rotating components which are attached to be rotatable relative to each other about an axis, and an additional component; and a shaft unit attached to the body, wherein each of at least two of the rotating components has contact portions, and the contact portions of one of the at least two rotating components comes in contact with the contact portions of another of the at least two rotating components to regulate a rotation range between the at least two rotating components, wherein the contact portions are configured such that contact between the contact portions gradually decreases as the contact portions repeatedly come in contact with each other due to relative rotation of the at least two rotating components, and regulation of rotation is eventually lost so that the rotation range between the at least two rotating components increases, wherein the additional component rotatably supports a first one of the at least two rotating components between the additional component and a second one of the at least two rotating components, and is fixed to the second one of the at least two rotating components, wherein the additional component has a hole for receiving in an attached relation an accessory, and wherein the hole is closed by the first one of the at least two rotating components and does not receive the accessory in a first state in which the rotation range of the at least two rotating components has not increased yet, and when the first state is changed to a second state, in which the rotation range has increased, the first one of the at least two rotating components is relatively rotated so that the hole is opened to receive the accessory.

2. The toy top according to claim 1, further comprising:

a biasing member which biases the first one of the at least two rotating components in a first rotating direction with respect to the second one of the at least two rotating components, wherein the at least two rotating components are configured such that when the first state is changed to the second state, the first one of the at least two rotating components is relatively rotated in a second rotating direction opposite to the first rotating direction against a biasing force of the biasing member.

3. The toy top according to claim 2, wherein the first one of the rotating components comprises a supporting portion which supports the biasing member and which closes the hole of the additional component in the first state and is moved in the second rotating direction across the hole to open the hole when the first state is changed to the second state, and wherein in the second state, an attaching portion of the accessory is inserted into the hole of the additional component to abut the supporting portion of the first one of the at least two rotating components, and rotation of the first one of the at least two rotating components by the biasing member is thereby regulated so that the second state is retained.

* * * * *